US011180951B2

(12) United States Patent
McNeill et al.

(10) Patent No.: US 11,180,951 B2
(45) Date of Patent: Nov. 23, 2021

(54) BOTTOM RAIL FOR USE WITH AN ARCHITECTURAL-STRUCTURE COVERING

(71) Applicant: Hunter Douglas Inc., Pearl River, NY (US)

(72) Inventors: David B. McNeill, Denver, CO (US); Nicholas E. Vanderkolk, Northglenn, CO (US)

(73) Assignee: HUNTER DOUGLAS INC., Pearl River, NY (US)

( * ) Notice: Subject to any disclaimer, the term of this patent is extended or adjusted under 35 U.S.C. 154(b) by 292 days.

(21) Appl. No.: 16/266,807

(22) Filed: Feb. 4, 2019

(65) Prior Publication Data

US 2019/0264499 A1 Aug. 29, 2019

Related U.S. Application Data

(60) Provisional application No. 62/635,190, filed on Feb. 26, 2018.

(51) Int. Cl.
*E06B 9/42* (2006.01)
*E06B 9/32* (2006.01)
(Continued)

(52) U.S. Cl.
CPC ..... *E06B 9/32* (2013.01); *A47H 23/01* (2013.01); *E06B 9/34* (2013.01); *E06B 9/388* (2013.01);
(Continued)

(58) Field of Classification Search
CPC ... E06B 9/34; E06B 9/388; E06B 9/42; E06B 2009/2435; A47H 23/01; Y10T 403/7018;
(Continued)

(56) References Cited

U.S. PATENT DOCUMENTS 1,499,821 A * 7/1924 Griffiths ..... E06B 9/46 160/392
4,170,810 A * 10/1979 Peleg ..... E04H 15/646 24/462
(Continued)

FOREIGN PATENT DOCUMENTS

AU 2009203048 A1 † 2/2010
EP 1 384 849 A2 † 1/2004
(Continued)

OTHER PUBLICATIONS

Partial European Search Report for the European Patent Application No. EP19159170, dated Jul. 30, 2019, 32 pages.

*Primary Examiner* — Jerry E Redman
*Assistant Examiner* — Jeremy C Ramsey
(74) *Attorney, Agent, or Firm* — Kacvinsky Daisak Bluni PLLC

(57) ABSTRACT

An improved bottom rail for an architectural-structure covering is disclosed. The bottom rail includes one or more channels. In use, a first channel may receive a bottom edge of the covering while a weight channel receives a weighted, longitudinal rod therein. Additionally, and/or alternatively, the bottom rail may include pucks for retaining the weighted, longitudinal rod within the weight channel. In use, the pucks are rotatable from a first unlocked position to a second locked position. In the first position, the pucks are slidably positionable along an outer surface of the longitudinal rod. In the second position, the pucks contact the longitudinal rod to thereby exert an additional downward force onto the longitudinal rod so that the longitudinal rod is retained within the weight channel.

10 Claims, 11 Drawing Sheets

(51) Int. Cl.

| | |
|---|---|
| ***E06B 9/34*** | (2006.01) |
| ***A47H 23/01*** | (2006.01) |
| ***E06B 9/388*** | (2006.01) |
| *E06B 9/24* | (2006.01) |

(52) U.S. Cl.
CPC ..... *E06B 9/42* (2013.01); *E06B 2009/2435* (2013.01)

(58) Field of Classification Search
CPC ..... Y10T 403/7021; Y10T 403/7022; Y10T 403/7024
See application file for complete search history.

(56) References Cited

U.S. PATENT DOCUMENTS

| | | | | |
|---|---|---|---|---|
| 5,647,421 | A * | 7/1997 | Hoffmann | E06B 9/40 160/120 |
| 6,978,821 | B2 | 12/2005 | Welfonder | |
| 9,567,802 | B2 | 2/2017 | Buccola, Jr. et al. | |
| 2012/0097346 | A1 | 4/2012 | Ng | |
| 2018/0119485 | A1* | 5/2018 | Colson | B29C 66/437 |

FOREIGN PATENT DOCUMENTS

| | | | | |
|---|---|---|---|---|
| JP | S5957610 | A | | 4/1984 |
| JP | S6034290 | U | | 3/1985 |
| JP | 2012251312 | A | † | 12/2012 |
| JP | 2017206875 | A | † | 11/2017 |
| TW | M443762 | U1 | † | 12/2012 |
| WO | 2012128295 | A1 | | 9/2012 |

* cited by examiner
† cited by third party

BOTTOM RAIL FOR USE WITH AN ARCHITECTURAL-STRUCTURE COVERING

CROSS-REFERENCE TO RELATED APPLICATIONS

This is a non-provisional of, and claims the benefit of the filing date of, U.S. provisional patent application No. 62/635,190, filed Feb. 26, 2018, titled "Bottom Rail for use with an Architectural-Structure Covering," the entirety of which application is incorporated by reference herein.

FIELD OF THE DISCLOSURE

The present disclosure relates generally to the field of architectural-structure coverings, and relates more particularly to an improved bottom rail for use with an architectural-structure covering.

BACKGROUND

Architectural-structure coverings may selectively cover an architectural structure such as, for example, a window, a doorway, a skylight, a hallway, an archway, a portion of a wall, etc. Generally speaking, architectural-structure coverings may include a covering that can be extended and retracted, for example, vertically extendable or retractable (e.g., capable of being lowered or raised, respectively, in a vertical direction) between an extended position and a retracted position for obscuring and exposing the underlying architectural structure. The architectural-structure covering may further include a bottom rail attached to a bottom edge of the covering. The bottom rail may be utilized to add weight along the bottom edge of the covering to, for example, encourage the covering to drop by gravity during extension. In addition, the bottom rail may be engaged by the user to move the covering between the extended and retracted positions, or to provide an aesthetic finish to an end of the covering. The weight of the bottom rail may be typically transferred to the covering. Depending on the type of covering being utilized, the weight of the bottom rail may cause a bottom portion of the covering to be positioned, such as shaped, differently from other portions of the covering positioned more distally from the bottom rail, which may reduce the aesthetic and/or functional characteristics of the covering.

Additionally, or alternatively, the covering may be coupled to the bottom rail by inserting the covering into a channel formed in the bottom rail. As such, the covering may be constricted or angled or otherwise affected by the insertion into the bottom rail, thereby affecting the appearance of the covering in a manner which may be undesirable.

Additionally, or alternatively, the bottom rail may incorporate a weighted, longitudinal rod to assist the covering in dropping by gravity during extension. Such weighted, longitudinal rod may also be used to adjust the skew of the covering.

It is with respect to these and other considerations that the present improvements may be useful.

SUMMARY

This Summary is provided to introduce in a simplified form, a selection of concepts that are further described below in the Detailed Description. This Summary is not intended to identify key features or essential features of the claimed subject matter, nor is it intended as an aid in determining the scope of the claimed subject matter.

Disclosed herein is an improved bottom rail for a covering of an architectural-structure covering. In one embodiment, the bottom rail is coupled to a covering of an architectural-structure covering. The bottom rail includes a front wall, a rear wall, and a channel formed between the front and rear walls. The channel being sized and configured to receive a bottom edge of the covering. The front wall includes an inwardly extending front projection and the rear wall includes an inwardly extending rear projection. The channel may include a recess for receiving a bottom edge of the covering. In accordance with one configuration, the front and rear projections are asymmetric (e.g., the front and rear projections have different sizes and/or shapes). That is, in one configuration, the front projection extends laterally inwards from the front wall by a greater distance than the rear projection extends laterally inwards from the rear wall.

Additionally, and/or alternatively, in one embodiment, the channel is aligned with the covering to minimize any undesirable aesthetics when the bottom rail is coupled to certain covering configurations. For example, in one embodiment, the channel includes a central plane, the rear wall is angled inward with respect to the central plane so that an upper end of the rear wall terminates at a location extending through the central plane. Additionally, and/or alternatively, the rear wall extends beyond the front wall.

A method for coupling a bottom rail to a covering of an architectural-structure covering is also disclosed. In one embodiment, the method includes coupling a strip to a bottom edge of the covering, wrapping at least a portion of the covering about the strip, and inserting the strip with the bottom edge of the covering into the channel formed in the bottom rail. In one embodiment, the strip and the bottom edge of the covering are positioned within a recess formed in the channel located between a base member and inwardly extending front and rear projections. In use, the inwardly extending front and rear projections provide an impediment to removal of the strip. In addition, the inwardly extending front and rear projections serve to prevent accidental disengagement of the bottom rail from the covering.

In one embodiment, the covering is a rollable, cellular style covering including front and rear sheets, and a plurality of spaced apart flexible vanes coupled to the front and rear sheets. A bottom rail configured for coupling to the rear sheet of such covering so that the bottom rail does not exert any direct force on the front sheet, and thus minimizes or avoids deformation of the front sheet of the covering. In addition, and/or alternatively, the channel for receiving the covering may be aligned with the rear sheet to further minimize any undesired aesthetics. The method for coupling the bottom rail to a type of cellular covering for an architectural-structure covering includes removing at least a portion of the front sheet of a lowermost cell of the covering, coupling a strip to the remaining portion of the rear sheet of the covering, and inserting the strip and a portion of the rear sheet into a channel formed in the bottom rail. In one embodiment, the rear sheet of the covering is wrapped about the strip so that the strip is at least partially surrounded or wrapped within the rear sheet of the covering.

A system and method for positioning a weight, such as, for example, a weighted, longitudinal rod within a weight channel formed in a bottom rail with the assistance of at least one weight retainer, such as, for example, a puck is also disclosed. The bottom rail used with such system and method (and which optionally, but not necessarily includes features described above for coupling to a covering)

includes a channel for receiving a weighted, longitudinal rod therein and one or more pucks positioned within the channel. In use, the pucks are movable, such as rotatable, from a first unlocked position to a second locked position. In the first unlocked position, the one or more pucks are slidably positionable along an outer surface of the longitudinal rod, and the longitudinal rod is movable within the channel. In the second locked position, the one or more pucks contact the longitudinal rod to exert pressure onto the longitudinal rod, sandwiching the rod between the pucks and the bottom rail so that the longitudinal rod is retained in a selected position with respect to the channel.

In one embodiment, the pucks each include a top surface and a bottom surface, wherein the bottom surface includes first and second grooves formed therein. In one embodiment, both of the top and bottom surfaces include first and second grooves formed therein. In one embodiment, the first groove includes a depth that is larger than a depth of the second groove. As such, in the first position, the first groove is in contact with the outer surface of the longitudinal rod, while in the second position, the second groove is in contact with the outer surface of the longitudinal rod. By rotating the pucks from the first position to the second position, the smaller (e.g., shallower) second grooves are moved into contact with the outer surface of the longitudinal rod as compared to the larger (e.g., deeper) first grooves. Contacting of the longitudinal rod with the shallower second grooves causes the pucks to exert pressure onto the longitudinal rod, thereby retaining the rod within the weight channel.

DETAILED DESCRIPTION

Figure 1:
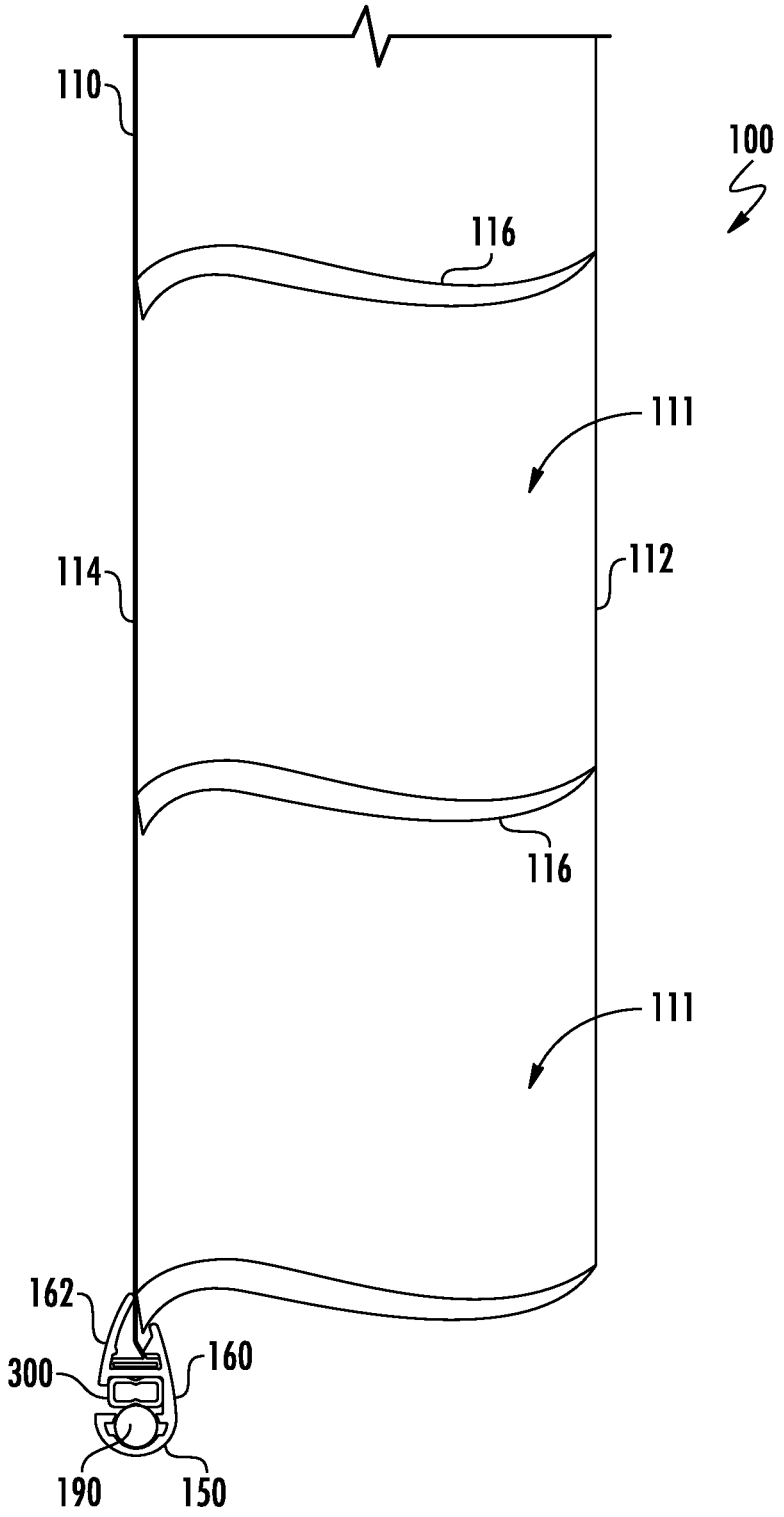
FIG. 1 is a partial, cross-sectional view illustrating an example embodiment of a bottom rail in accordance with an illustrative embodiment of the present disclosure, the bottom rail being coupled to an example embodiment of a covering of an architectural-structure covering.

Various features, aspects, or the like of a bottom rail for architectural-structure coverings will now be described more fully hereinafter with reference to the accompanying drawings, in which one or more aspects of the bottom rail will be shown and described. It should be appreciated that the various features, aspects, or the like may be used independently of, or in combination, with each other. It will be appreciated that a bottom rail as disclosed herein may be embodied in many different forms and should not be construed as being limited to the embodiments set forth herein with all features being present. Rather, these embodiments are provided so that this disclosure will convey certain aspects of the bottom rail to those skilled in the art. In the drawings, like numbers refer to like elements throughout unless otherwise noted.

As will be described in greater detail below, the bottom rail of the present disclosure may be configured to be coupled to a covering of an architectural-structure covering so that the covering is properly position in the extended position while preventing or minimizing the bottom portion of the covering from having an undesired aesthetic finish (e.g., crushed or generally shaped differently from other portions of the covering). Additionally, and/or alternatively, the bottom rail may incorporate an improved retaining mechanism for retaining a weighted, longitudinal rod therein, the retaining mechanism preventing unwanted movement of the longitudinal rod with respect to the bottom rail.

Referring to FIG. 1, a cross-sectional side view of an architectural-structure covering 100 provided with a bottom rail 150 in accordance with various aspects of the present disclosure is shown. As will be readily appreciated by one of ordinary skill in the art, the architectural-structure covering 100 includes a covering 110. In use, the architectural-structure covering 100 may be configured to be mounted to a wall or other structure above an architectural structure such as, for example, a window, a doorway, a skylight, a hallway, an archway, a portion of a wall, etc., in a conventional manner that will be recognized by those of ordinary skill in the art. In use, the covering 110 may be configured to be vertically extended and retracted between an extended position, wherein the covering 110 may partially or entirely cover the architectural structure, and a retracted position, wherein the covering 110 and the bottom rail 150 may be retracted, and at least the covering 100 is substantially hidden.

It should be understood that the architectural-structure covering 100 is but one example and that other configurations may be used. As such, the covering 110 may be any covering now known or hereafter developed, constructed from any suitable material. For example, the covering 110 may be constructed from a fabric material of a conventional type that will be recognized by those of ordinary skill in the art. Alternatively, the covering 110 may be constructed from a plastic material, a vinyl material, a wood material, a metal material, etc. Furthermore, the covering 110 may be any type of covering, for example, a pleated shade, a honeycomb shade, a Roman style shade, a Venetian blind, a roller shade, a stackable style, a cellular style, a support sheet with slats or vanes, etc. According to the illustrative embodiment illustrated in FIG. 1, the covering 110 may be a rollable covering including front and rear sheets 112, 114, and a plurality of spaced apart flexible vanes 116 coupled to the front and rear sheets 112, 114. In use, in addition to being extendable and retractable, the covering 110 may be movable between an open configuration (shown in FIG. 1) and a closed configuration when the covering 110 is in an extended configuration. In the closed configuration during, for example, extension and retraction, the front and rear sheets 112, 114 may be relatively close together and the vanes 116 may extend substantially vertically in an approximately coplanar, contiguous relationship with the front and rear sheets 112, 114. In the open configuration, the front and rear sheets 112, 114 move with respect to each other to shift the vanes 116 so that they extend substantially horizontally between the front and rear sheets 112, 114. As will be appreciated, although the description will proceed in relation to the illustrated covering 110, such is merely one example of a covering that can be used with the disclosed bottom rail, and should not be construed as limiting.

Figure 2:
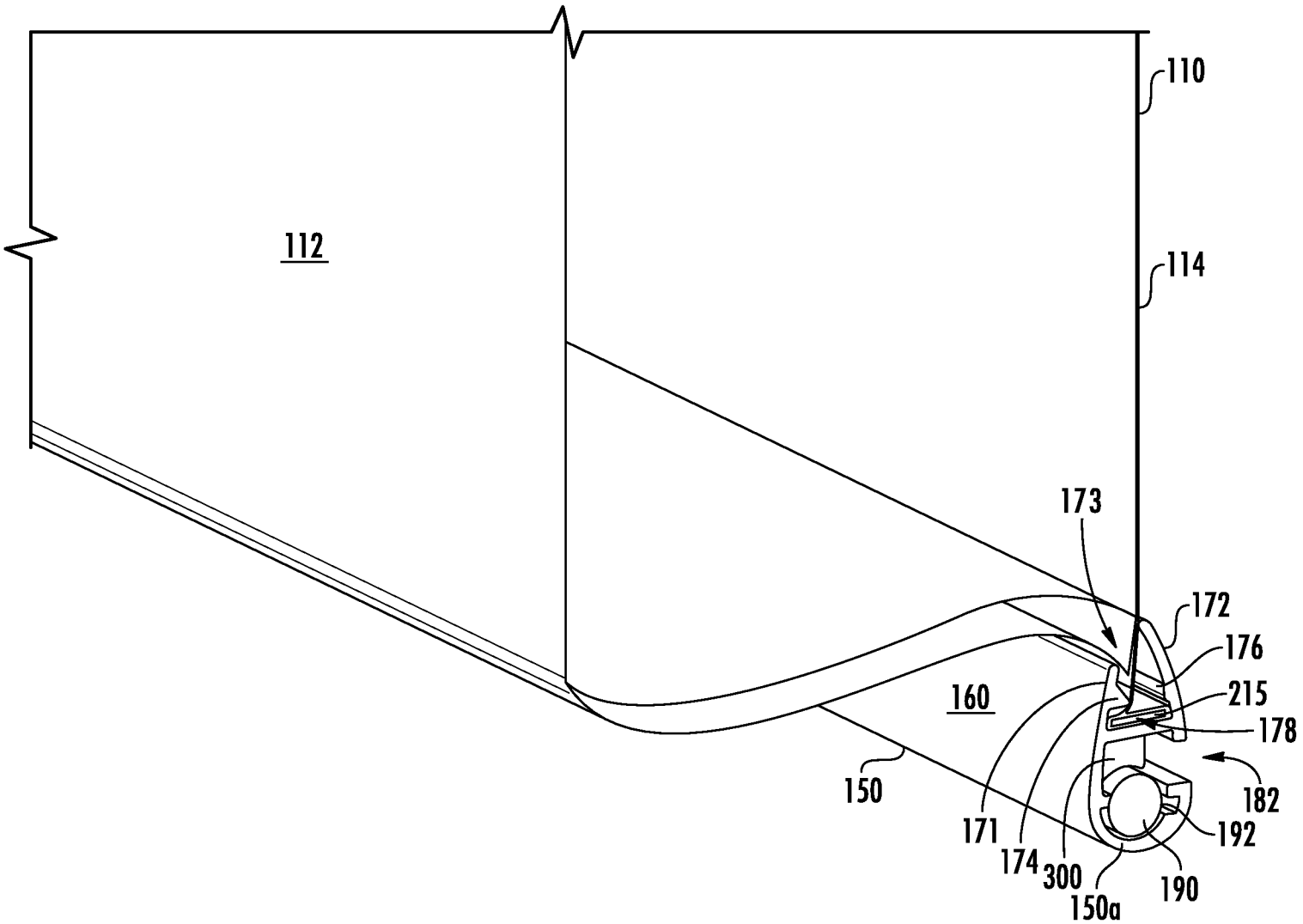
FIG. 2 is a front perspective view illustrating the bottom rail shown in FIG. 1.
Figure 3:
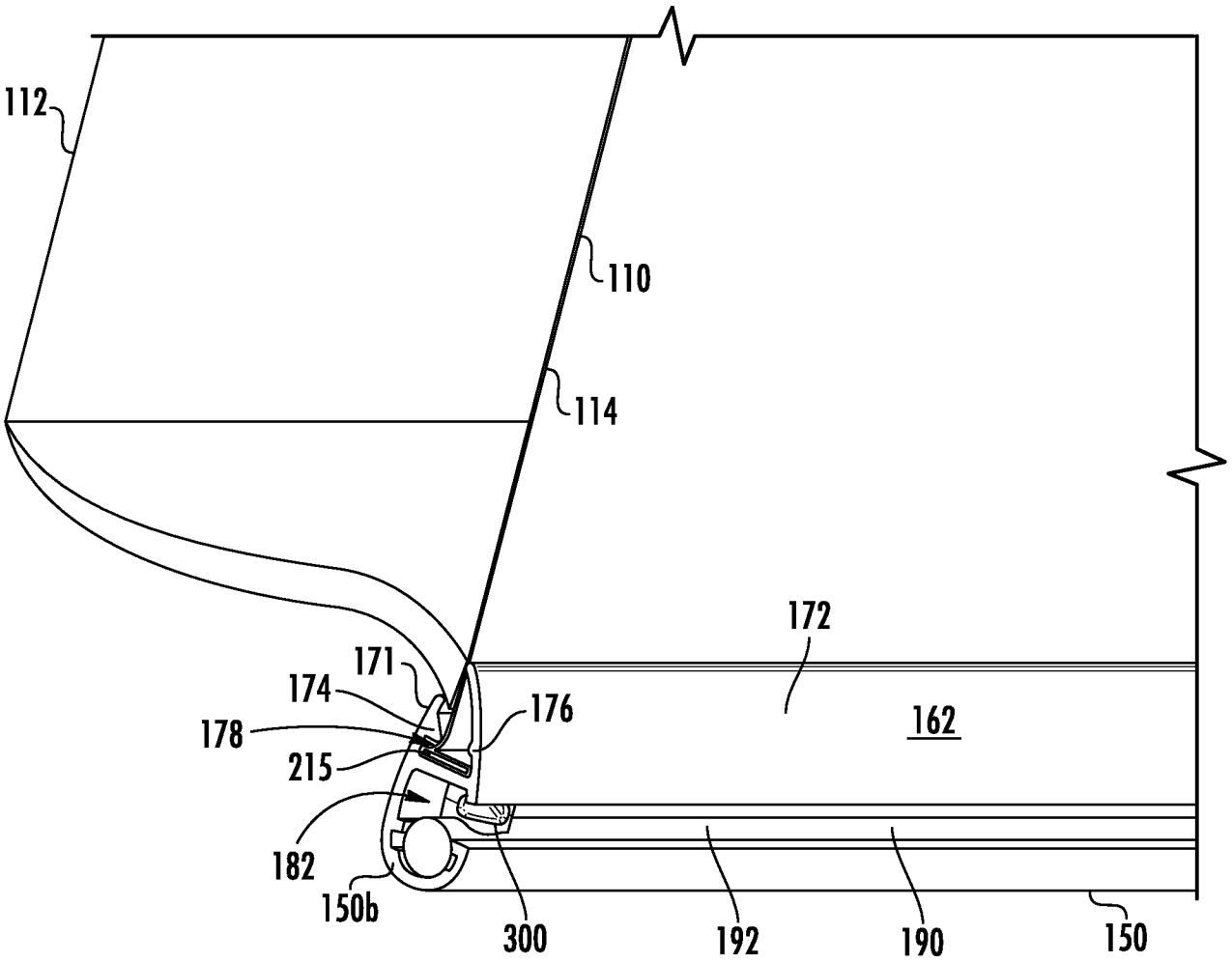
FIG. 3 is a rear perspective view illustrating the bottom rail shown in FIG. 1.
Figure 4:
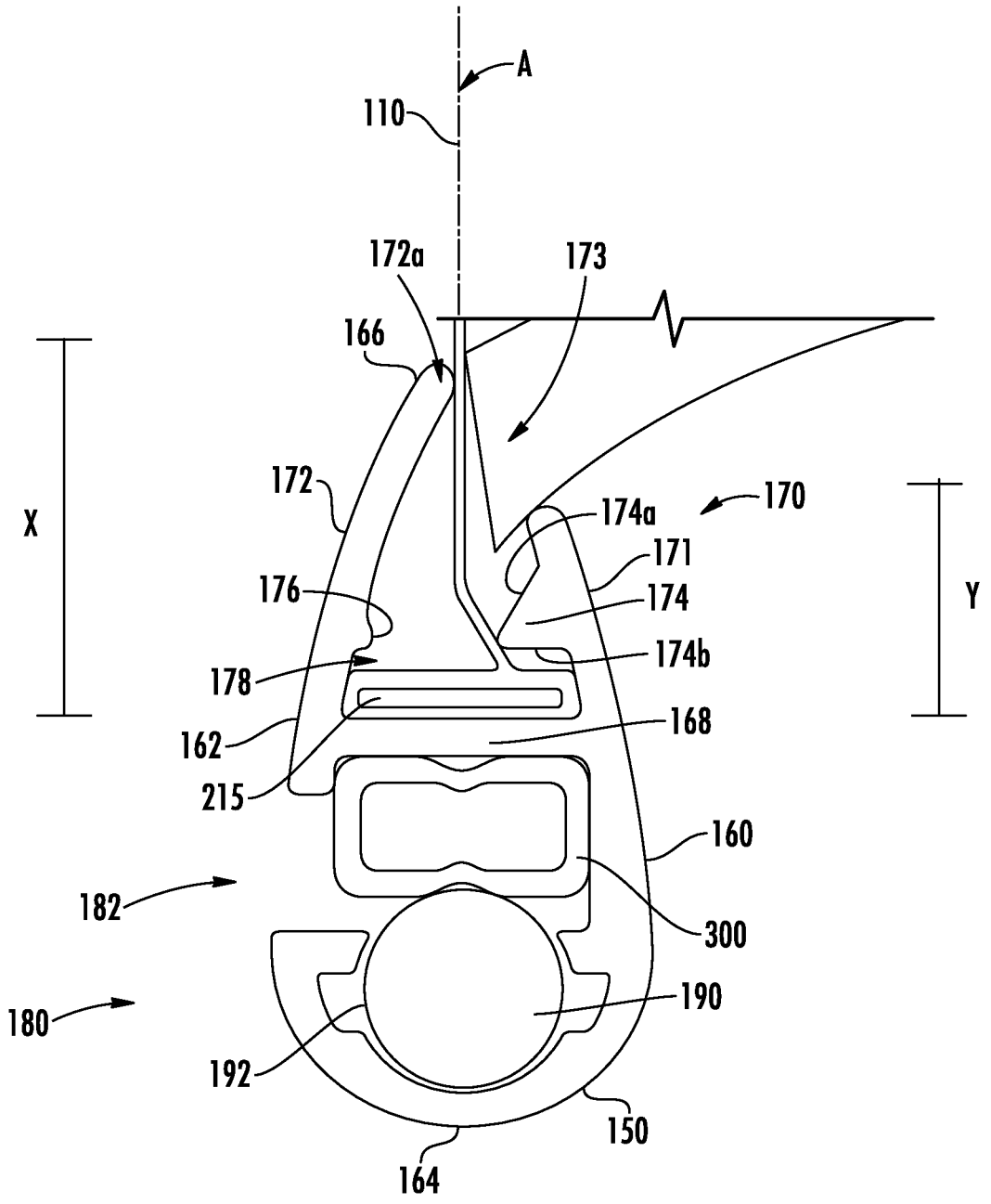
FIG. 4 is a partial, detailed view of the bottom rail shown in FIG. 1.

Referring to FIGS. 2-4, an example of a bottom rail 150 with one or more features disclosed herein (which may be used separately or in various combinations which may be appreciated by those of ordinary skill in the art) is illustrated. In use, the bottom rail 150 may be an elongate member that is coupled to or mounted (such terms may be used interchangeable herein without the intent to limit) a bottom edge of the covering 110. For example, the elongated member may be a rigid elongated member. Generally speaking, the bottom rail 150 provides a user a convenient location or "touchpoint" at which the user may engage the covering 110, for example, to pull up or down on the bottom rail 150 to raise or lower the covering 110, respectively. The bottom rail 150 may also be provided to add weight to the bottom edge of the covering 110 to encourage the covering 110 to drop under a gravitational force during extension. End caps (not shown) may be disposed on opposing longitudinal ends 150*a*, 150*b* of the bottom rail 150 (FIGS. 2 and 3). In some embodiments, the end caps may be coupled to the ends 150*a*, 150*b* of the bottom rail 150 using suitable mechanical fasteners.

Referring to FIGS. 2-4, the bottom rail 150 may include a front surface 160, a rear surface 162, a bottom end 164, and a top end 166. In addition, the bottom rail 150 may generally be constituted to comprise a top portion 170 (FIG. 4), and a bottom portion 180. The bottom rail 150 may further include a base member 168 separating the top portion 170 from the bottom portion 180.

The bottom rail 150 includes a channel 173 for receiving a bottom edge of the covering 110. For example, the top portion 170 of the bottom rail 150 may include a channel 173. The channel 173 may extend the entire length of the bottom rail 150. In use, the bottom edge of the covering 110 may be inserted into the channel 173 via, for example, an opening formed in the top end thereof. In this manner, the bottom edge of the covering 110 may be coupled to the bottom rail 150.

Referring to FIG. 4, in one embodiment, the bottom rail 150, for example, the top portion 170 of the bottom rail 150, may include a front wall 171, a rear wall 172, and a channel 173 positioned between the front and rear walls 171, 172. The channel 173 may extend a longitudinal length of the bottom rail 150. That is, in one embodiment, the channel 173 may extend from one end 150*a* (FIG. 2) of the bottom rail 150 to the other end 150*b* (FIG. 3) of the bottom rail 150. As will be described in greater detail below, the channel 173 may be sized and configured to receive a bottom edge of the covering 110.

As shown in FIG. 4, a central plane A extends through the channel 173. In one embodiment, the rear wall 172 may be angled or curved with respect to the central plane A. More specifically, the rear wall 172 may be inwardly angled or curved so that an upper end 172*a* of the rear wall 172 terminates adjacent to the central plane A. Similarly, as shown in the example embodiment, the front wall 171 may be angled or curved inwardly with respect to the central plane A. Thus, as illustrated, the rear wall 172 is angled inward with respect to the front wall 171, and the front wall 171 is angled inward with respect to the rear wall 172. By incorporating angled or curved front and rear walls 171, 172, the rear wall 172 contacts the covering 110 at or adjacent to a location passing through the central plane A of the channel 173, and thus the rear wall 172 keeps the covering 110 aligned with the longitudinal axis of the covering 110 to prevent a potentially undesirable aesthetic finish to the covering 110 (e.g., tilting, skewing, etc.).

In addition, as illustrated, the rear wall 172 may optionally extend higher than the front wall 171, as measured from the base member 168. That is, for example, the rear wall 172 may extend from the base member 168 by a first distance X, and the front wall 171 may extend from the base member 168 by a second distance Y, the first distance X being greater than the second distance Y. By incorporating a higher rear wall 172, the bottom rail 150 is better able to prevent a covering 110 made from a relatively stiff material from causing the bottom rail 150 to rotate out of vertical alignment. In particular, because the covering 110 is wrapped around a strip 215, as will be described in greater detail below, if the covering is made from a relatively stiff material, the covering 110 may tend to curve in the same direction in which the covering 110 is curved about the strip 215. The higher rear wall 172 assists in preventing the covering 110 from continuing to curve and from torqueing the bottom rail 150 with it.

In one embodiment, as illustrated, for example, in FIG. 4, the channel 173 formed in the bottom rail 150 may include a recess 178 configured to receive and hold the bottom edge of the covering 110. That is, the channel 173 formed in the bottom rail 150 may include a recess 178 adapted and configured to enable the bottom edge of the covering 110 to be received therein, while providing an impediment to, for example, unwanted rotation of the bottom edge of the covering 110 and a strip 215 that may be coupled thereto, as will be described in greater detail below, and/or accidental decoupling of the covering 110 from the bottom rail 150.

In an embodiment of a recess 178 for coupling a covering 110 to a bottom rail 150 as illustrated in FIG. 4, the front wall 171 may include an inwardly extending projection 174. Similarly, the rear wall 172 may include an inwardly extending projection 176. As can be seen the front and rear projections 174, 176 extend inwardly and may oppose each other. Incorporation of the front and rear projections 174, 176 facilitates the forming of a recess 178 in the channel 173 for receiving the bottom edge of the covering 110 when the covering 110 is inserted into the channel 173. The front projection 174 may include a top surface 174*a* and a bottom surface 174*b*. As shown, the top surface 174*a*, may be inclined while the bottom surface 174*b* may be substantially straight for reasons that will become apparent below.

As will be described in greater detail below, in use, the bottom edge of the covering to be coupled to the bottom rail (e.g., covering 110) may be wrapped about a strip 215 such as a polycarbonate strip or "polystrip" (commonly used in the industry to couple fabrics to a more rigid element, such as by insertion of the fabric, wrapped around an edge of the polycarbonate strip, into a slot or recess formed in the rigid element). The strip 215, along with the portion of the covering 110 wrapped thereabout, may be inserted into the channel 173, past the space or gap between the front projection 174 and the rear projection 176, and into the recess 178 formed in the channel 173 of the bottom rail 150. As illustrated, the front and rear projections 174, 176 are sized and configured to enable the strip 215, along with the portion of the covering 110 wrapped thereabout, to slide past and into the recess 178 formed in the channel 173 during insertion, while simultaneously restricting the strip 215, along with the portion of the covering 110 wrapped thereabout, from moving out of the recess 178 (e.g., to slide past the front and rear projections 174, 176 and out of the channel 173 to disengage the covering 110 from the bottom rail 150). During installation, the strip 215, along with the portion of the covering 110 wrapped thereabout, may contact the inclined top surface 174*a* of the front projection 174, thus assisting the strip 215, along with the portion of the covering 110 wrapped thereabout, in sliding through the space or gap formed between the front and rear projections 174, 176 and into the recess 178 formed in the channel 173 of the bottom rail 150. Meanwhile, accidental removal of the strip 215 along with the portion of the covering 110 wrapped thereabout is rendered more difficult as, during removal, the strip 215, along with the portion of the covering 110 wrapped thereabout, contacts the straight edge bottom surface 174*b* of the front projection 174, which tends to prevent the strip 215, along with the portion of the covering 110 wrapped thereabout, from sliding through the space or gap formed between the front and rear projections 174, 176 and out of the channel 173.

As illustrated, in one embodiment, the front projection 174 and the rear projection 176 may be asymmetric in, for example, size and shape. That is, in one embodiment, the front projection 174 may extend or project laterally inwards from the front wall 171 by a greater distance than the rear projection 176 extends or projects laterally inwards from the rear wall 172. By providing a larger front projection 174 and a smaller rear projection 176, the channel 173 and hence the bottom rail 150 may have a narrower overall configuration than if two similarly sized projections were used. It should be noted that, in use, the rear projection 176 may be relatively small because the rear projection 176 generally or typically is not operating under, or is not subject to, significant forces. That is, in use, the larger front projection 174 acts as a stop and is subject to forces when weight is applied to the covering 110, such as, for example, when the covering 110 is being extended or retracted. Meanwhile, the rear projection 176 generally or typically is not subject to forces when weight is applied to the covering 110, such as, for example, when the covering 110 is being extended or retracted. Rather, the rear projection 176 mainly functions when the bottom rail 150 is at rest such as, for example, when the bottom rail 150 is resting on a window sill and is lifted by a user relative to the covering 110. As such, the rear projection 176 generally or typically functions in low-tension or low-force situations and as a result, the rear projection 176 is not required to resist significant forces.

Moreover, during manufacturing, the rear projection 176 may serve as an indicator that the strip 215 and the bottom edge of the covering 110 wrapped thereabout are properly positioned. In use, it may be difficult for a manufacturer or installer to visually determine whether the strip 215 is properly located within the recess 178 formed in the channel 173 of the bottom rail 150, for example, because of the depth of the channel 173. Pushing the strip 215 and the bottom edge of the covering 110 wrapped thereabout past the rear projection 176 provides an indicator such as, for example, a tactile or audible indication that the strip 215, and the bottom edge of the covering 110 wrapped thereabout, are properly seated.

Figure 5:
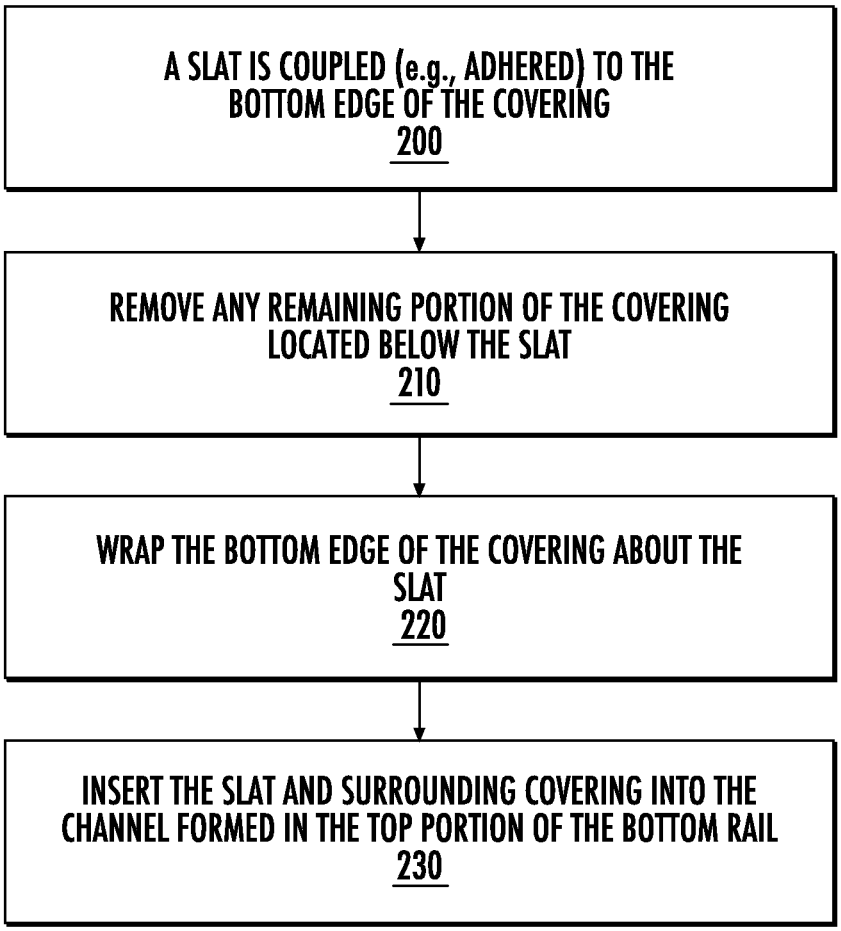
FIG. 5 is an illustrative example embodiment of a method of coupling a bottom rail to a covering of an architectural-structure covering.

Referring to FIG. 5, an illustrative example embodiment of a method of inserting the covering 110 of an architectural-structure covering 100 into the bottom rail 150 of the present disclosure will now be described. In one embodiment, at 200, a strip or slat 215 (used interchangeably herein without the intent to limit) such as, for example, a polycarbonate strip, may be coupled to or adjacent to the bottom edge of the covering 110. The polycarbonate strip 215 may be coupled by any suitable means now known or hereafter developed. For example, the polycarbonate strip 215 may be provided with an adhesive on the front and back surfaces thereof. At 210, after coupling the strip 215 to or adjacent to the bottom edge of the covering 110, any remaining portion of the covering 110 located below the strip 215 may be removed. At 220, the bottom edge of the covering 110 may be wrapped about the strip 215 so that the strip 215 may be surrounded or wrapped within the covering 110. In one embodiment, the bottom edge of the covering 110 may be wrapped forwardly so that when positioned within the recess 178 formed in the channel 173 of the bottom rail 150, the bottom edge of the covering 110 initially extends toward the front wall 171 of the bottom rail 150 (e.g., in a clockwise direction as shown in FIG. 4), although it is envisioned that the strip 215 may be wrapped in the opposite direction. The direction of the wrap may be dependent on the type of covering 110 being utilized and its direction of unwinding off of the rotatable member of the architectural-structure covering 100. Additionally, and/or alternatively, the bottom edge of the covering 110 may be wrapped about the strip 215 twice, although it is envisioned that the bottom edge of the covering 110 may be wrapped more or fewer times. At 230, the strip 215 with the bottom edge of the covering 110 may be inserted into the channel 173 formed in the top portion 170 of the bottom rail 150. In one embodiment, the strip 215 with the bottom edge of the covering 110 may be received within the channel 173 via the top end thereof. During this process, the strip 215 and the bottom edge of the covering 110 may be positioned within the recess 178 formed in the channel 173 located between the base member 168 and the inwardly extending front and rear projections 174, 178. In this manner, during use, the weight of the bottom rail 150 assists with holding the covering 110 in a taut condition. In addition, the inwardly extending front and rear projections 174, 178 provide an impediment to removal and/or rotation of the strip 215 and thus prevent accidental disengagement of the covering 110 from the bottom rail 150. It should be understood, that alternate ways of coupling the bottom rail 150 to the covering 110 are envisioned including, for example, slidably inserting the strip 215 and bottom edge of the covering 110 into the channel 173 via an end thereof.

Figure 6:
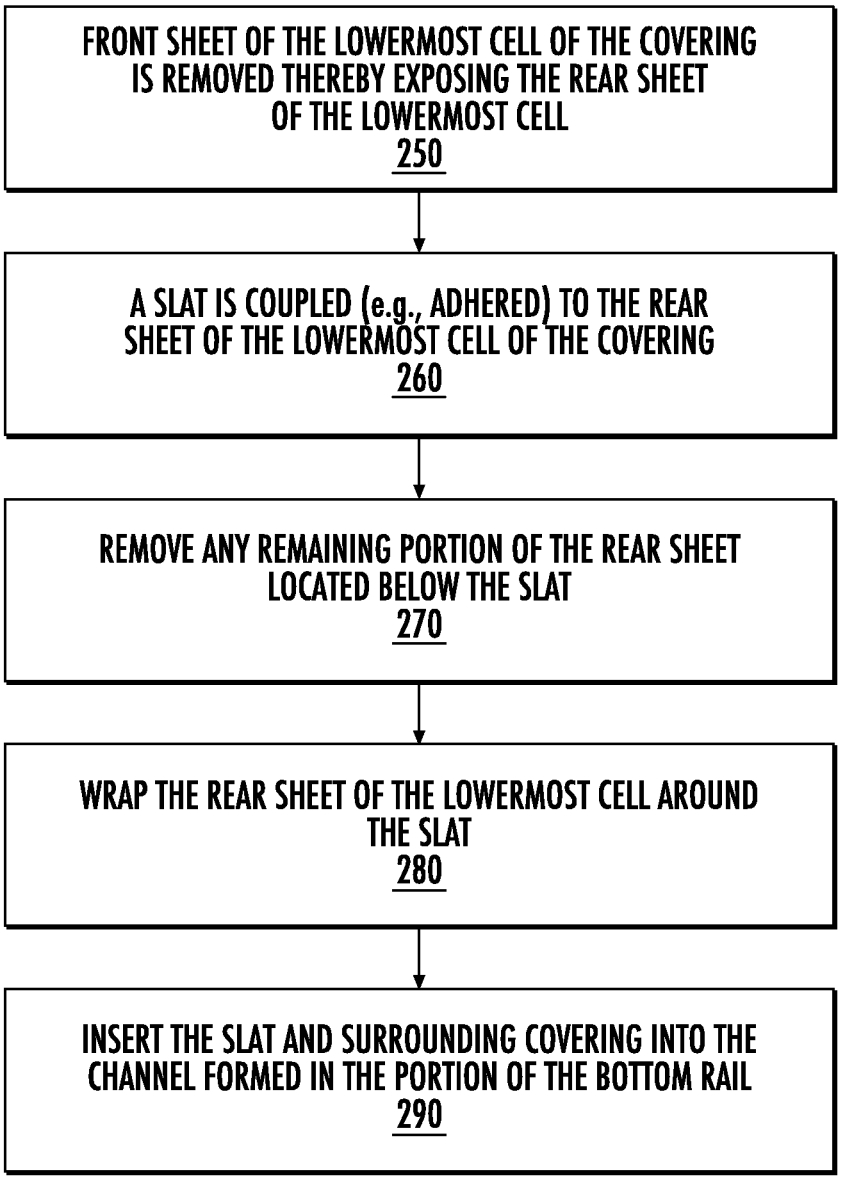
FIG. 6 is an alternate illustrative example embodiment of a method of coupling a bottom rail to a covering of an architectural-structure covering.

Referring to FIG. 6, an alternate, illustrative example embodiment of a method of inserting the covering 110 of an architectural-structure covering 100 into the bottom rail 150 of the present disclosure will now be described. The method described in connection with FIG. 6 is substantially similar to the method described above in connection with FIG. 5 except as described herein. As previously mentioned, in one embodiment, the covering 110 may include a cellular structure having a front sheet 112, a rear sheet 114, and a plurality of vanes 116. The covering 110 may also define or include one or more cells 111 operatively positioned between spaced apart vanes 116. At 250, the front sheet 114 of the lowermost cell 111 of the covering 110 may be removed (e.g., cut) thus exposing or leaving only the rear sheet 114 of the lowermost cell 111. At 260, as previously mentioned, a strip 215 may be coupled to the rear sheet 114 of the lowermost cell 111. At 270, as previously mentioned, after coupling the strip 215 to the rear sheet 114 of the lowermost cell 111, any remaining portion of the rear sheet 114 located below the strip 215 may be removed. At 280, as previously mentioned, the rear sheet 114 of the lowermost cell 111 may be wrapped about the strip 215 so that the strip 215 is preferably surrounded or wrapped within the rear sheet 114 of the lowermost cell 111. At 290, as previously mentioned, the strip 215 with the rear sheet 114 of the lowermost cell 111 wrapped thereabout may be inserted into the channel 173 formed in the top portion 170 of the bottom rail 150.

In this manner, the bottom rail 150 is coupled to the rear sheet 114 of the covering 110. In addition, since the bottom rail 150 is coupled to the rear sheet 114 only (i.e., the bottom rail 150 is not directly coupled to the front sheet 112 of the covering 110), the front sheet 112 is not crushed by the bottom rail 150, thus providing a pleasing aesthetic finish in embodiments where a cellular covering such as illustrated in FIG. 1 is utilized.

In accordance with another feature or aspect of the bottom rail, a bottom rail for coupling to a covering of an architectural-structure covering is also described in this disclosure, the bottom rail 150 including a channel 182 (referred to herein as a weight channel without the intent to limit) for receiving a longitudinal rod 190 therein and at least one puck 300 positioned within said weight channel 182. When in a first position, said at least one puck 300 is slidably positioned along an outer surface 192 of said longitudinal rod 190 and said longitudinal rod 190 is slidably positioned within said weight channel 182, and, when in a second position, said at least one puck 300 contacts said longitudinal rod 190 to retain a position of said longitudinal rod 190 within said weight channel 182. These features which are shown in FIGS. 2-4 may be used independently in any prior art bottom rail having a prior art channel being sized and configure to receive a bottom edge of the covering to couple the covering to the bottom rail. Alternatively, these features may be used in combination with the some or all features of the first channel of the bottom rail as described in this disclosure. The bottom rail 150 including a weight channel 182 will be described using the FIGS. 2-4, without intent to limit it to the particular details of the top channel shown in these figures.

As shown, if the bottom rail 150 has top and bottom portions (such as the illustrated embodiment including a first channel 173 for receiving a bottom edge of the covering 110), the weight channel 182 may be formed in a bottom portion 180 of the bottom rail 150, although it is envisioned that the weight channel 182 may be formed anywhere within the bottom rail 150 including the top portion 170. However, it should be appreciated by one of ordinary skill in the art, that the bottom rail 150 may not include "first" and "weight" channels, nor "top" and "bottom" portions, but rather may include either feature independently of the other.

The weight channel 182 may be a rear facing channel with its opening formed in the rear surface 162 of the bottom rail 150. In use, the rod 190 may be slidably inserted into the weight channel 182 from one of the longitudinal ends 150*a*, 150*b* of the bottom rail 150. Alternatively, the rod 190 may be inserted via the rear facing weight channel 182. The rod 190 may extend the full-length of the channel 182 or only a partial length thereof.

The rod 190 may be secured within the second channel 182 by any means now known or hereafter developed. Referring to FIGS. 1, 3, 4, 11 and 12, in one example embodiment, the rod 190 may be positioned within the weight channel 182 of the bottom rail 150 with the assistance of one or more pucks 300. As will be described in greater detail below, one or more pucks 300 may be inserted into the weight channel 182 formed in the bottom portion 180 of the bottom rail 150 along the longitudinal length of the rod 190 for positioning the rod 190 with respect to the bottom rail 150. In use, the one or more pucks 300 may be movable, such as rotatable, from a first position (shown in FIG. 11) to a second position (shown in FIG. 12) with respect to the bottom rail 150 and rod 190, wherein, in the first position (FIG. 11) the one or more pucks 300 are slidably positioned along the outer surface 192 of the rod 190, while in the second position (FIG. 12), the one or more pucks 300 can apply a force to the longitudinal rod 190 so that the longitudinal rod 190 is held in a desired position or location with respect to the weight channel 182 (e.g., in the second position, the one or more pucks 300 contact the longitudinal rod 190 to retain a position of the longitudinal rod 190 within the weight channel 182).

Referring to FIGS. 7-10, the pucks 300 may include a top surface 302, a bottom surface 304, and one or more side surfaces 306. As shown, the pucks 300 may have a generally cylindrical shape, although it is envisioned that other shapes may be used. In use, the pucks 300 may have any shape and/or configuration that, in a first position (FIG. 11) enables the pucks 300 to be slidably positionable along the length of the rod 190 and enables the rod 190 to be slidably positionable within the weight channel 182 of the bottom rail 150. Meanwhile, in a second position (FIG. 12), the pucks 300 apply an increased force against the outer surface 192 of the rod 190 to hold or retain the position of the pucks 300 with respect to the rod 190 and hence the position of the rod 190 with respect to the weight channel 182 of the bottom rail 150.

In one embodiment, as illustrated, the bottom surface 304 includes a first groove 310 formed therein. In addition, the bottom surface 304 includes a second groove 312 formed therein. As shown, the first and second grooves 310, 312 formed in the bottom surface 304 may be positioned so that they are transverse with respect to each other, although it is envisioned that the first and second grooves 310, 312 may be positioned at a greater or lesser angle with respect to each other.

Figure 7:
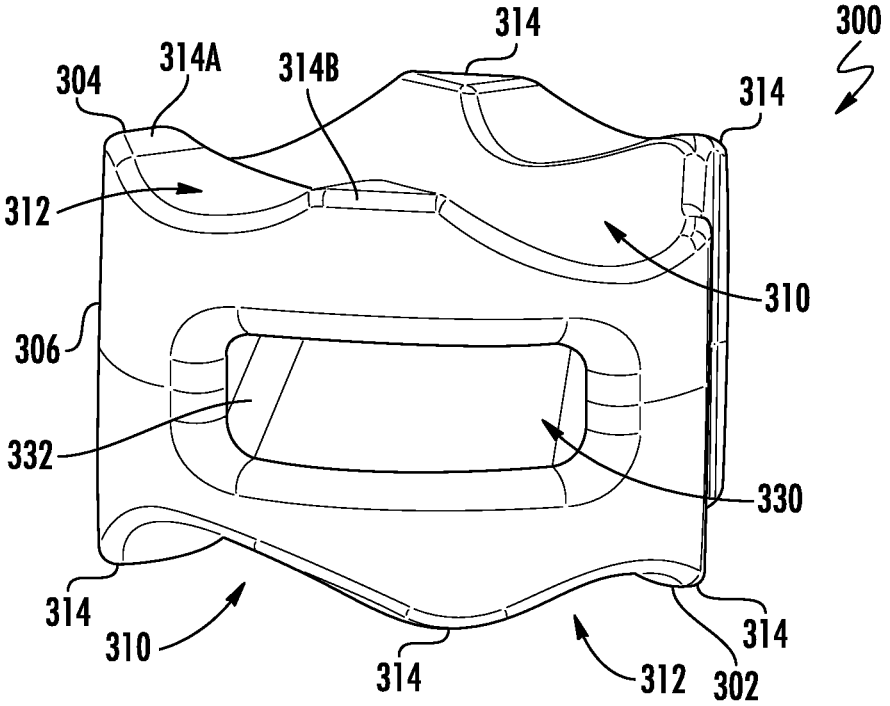
FIG. 7 is a bottom, front perspective view illustrating an example embodiment of a puck for securing a rod within a channel formed in the bottom rail.
Figure 8:
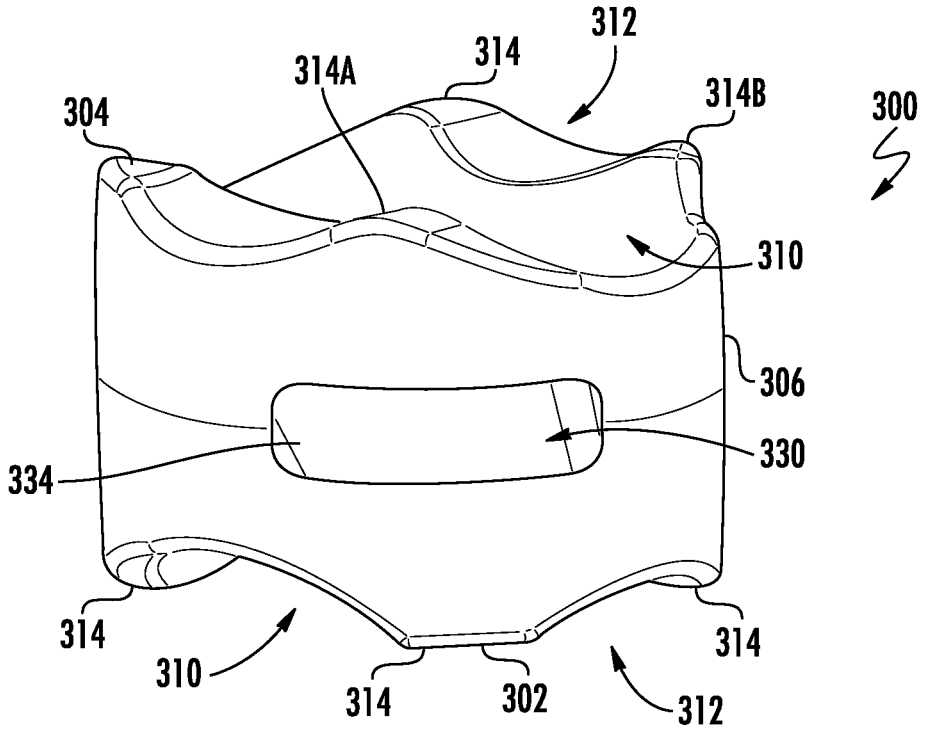
FIG. 8 is a bottom, rear perspective view of the puck shown in FIG. 7.
Figure 9:
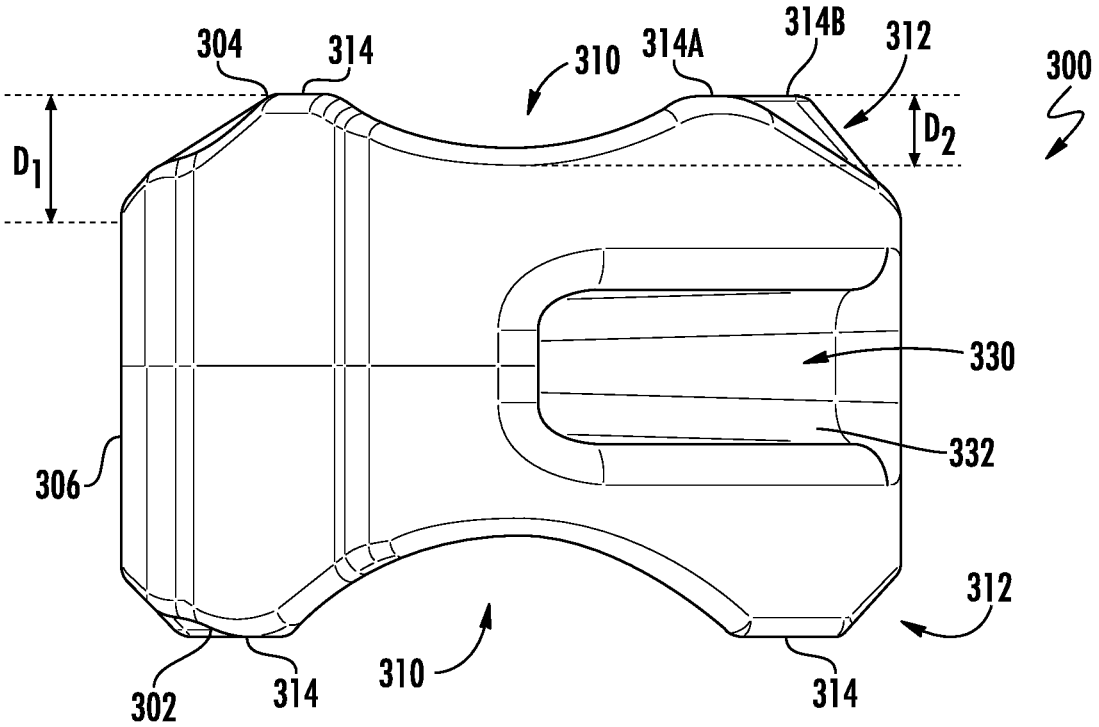
FIG. 9 is a side view of the puck shown in FIG. 7.
Figure 10:
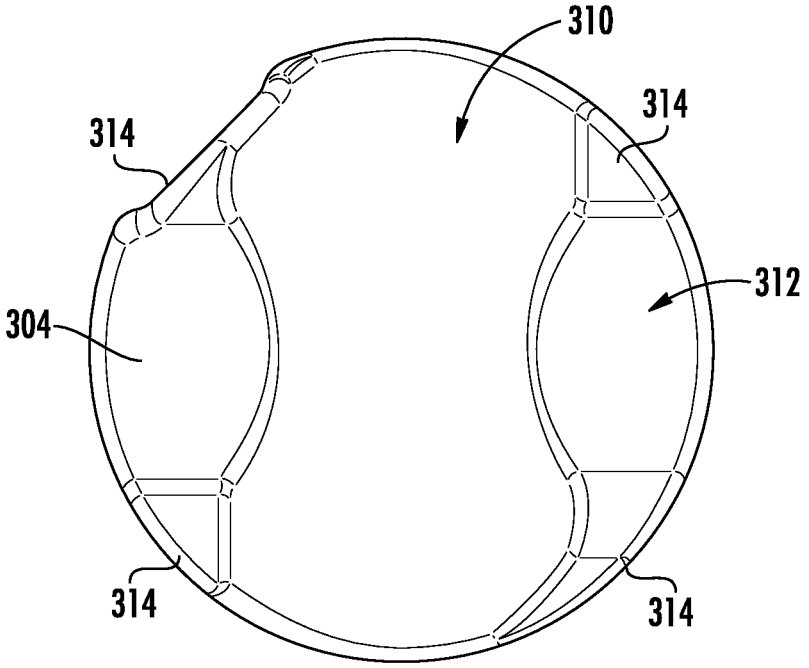
FIG. 10 is a bottom view of the puck shown in FIG. 7.
Figure 11:
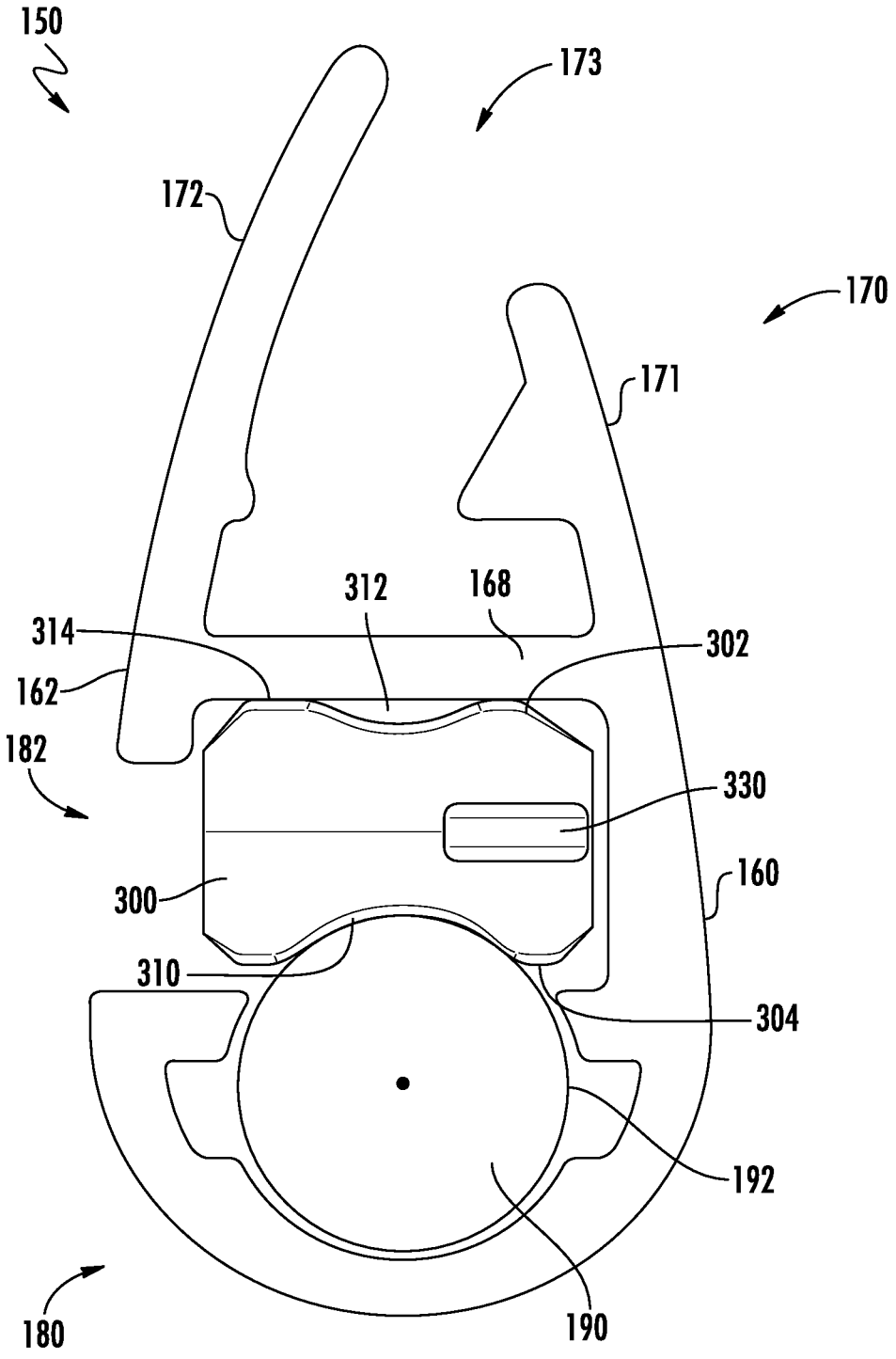
FIG. 11 is a cross-sectional view of the puck shown in FIG. 7 positioned within an example embodiment of a bottom rail, the puck shown in the first unlocked position.
Figure 12:
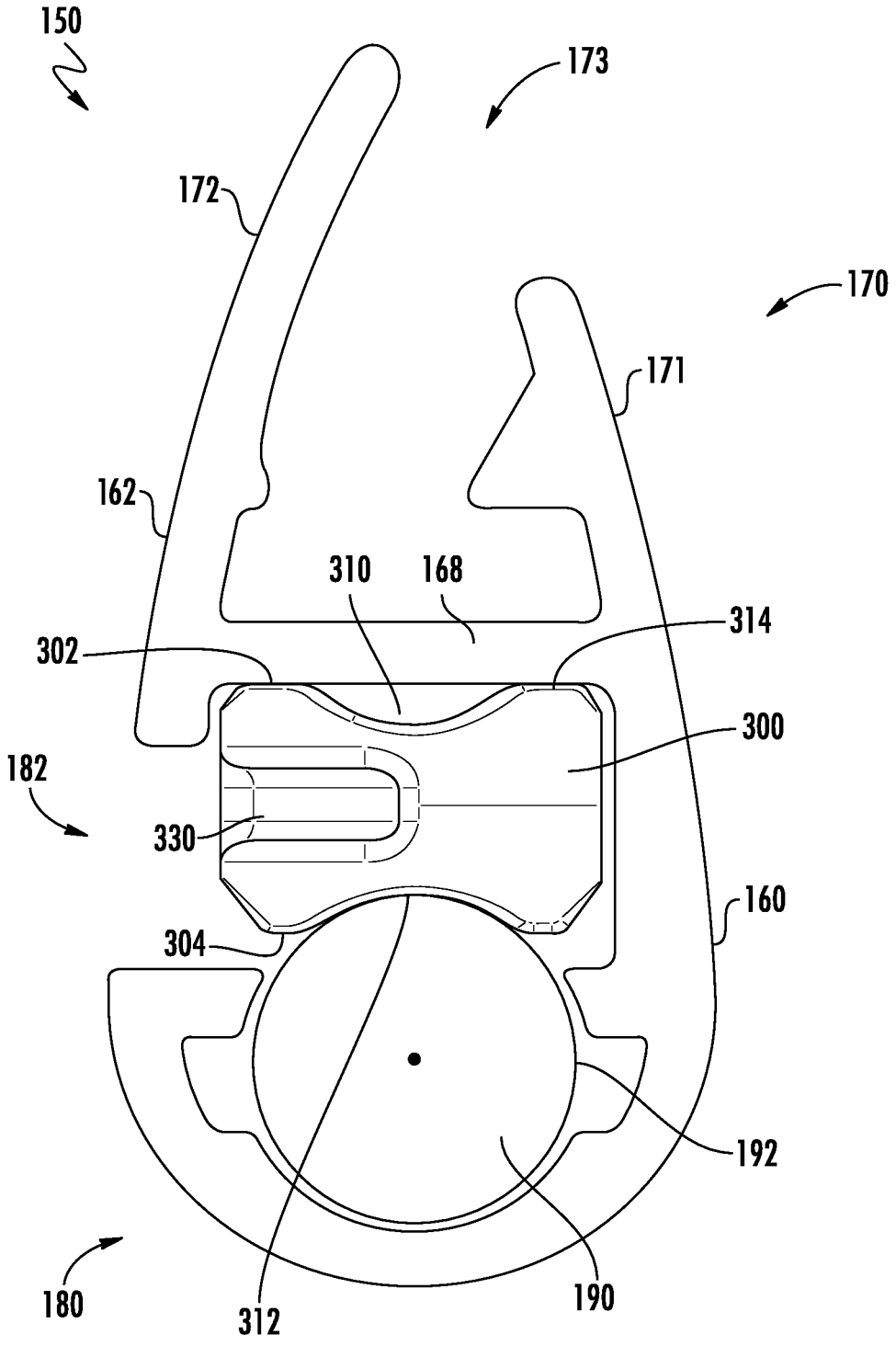
FIG. 12 is a cross-sectional view of the puck shown in FIG. 7 positioned within an example embodiment of a bottom rail, the puck shown in the second locked position.

Referring to FIGS. 7-9, the top surface 302 of the pucks 300 may also include first and second grooves 310, 312 formed therein. By providing first and second grooves 310, 312 in the top surface 302, as well as the bottom surface 304, the puck 300 may be inserted into the weight channel 182 in any orientation with either the top or the bottom surface 302, 304 in contact with the rod 190. Because the top surface 302 is similar to the bottom surface 304, detailed description of the top surface 302 is omitted for sake of brevity. It should be noted that while the pucks 300 have been described and illustrated as including first and second grooves 310, 312 formed in their top and bottom surfaces 302, 304, it is envisioned that the grooves 310, 312 may be formed in only one surface thereof.

As shown, by forming first and second grooves 310, 312 in the bottom surface 304 of the pucks 300, the periphery of the bottom surface 304 appear to have a plurality of peaks 314 positioned between valleys formed by the first and second grooves 310, 312. As illustrated, the leading peak 314A may have a rounded edge to facilitate or assist the puck 300 rolling or sliding over the rod 190 as the puck is rotated between the first (FIG. 11) and second (FIG. 12) positions. Meanwhile, the trailing peak 314B may have a flatter edge for contacting the bottom surface of the base member 168 of the bottom rail 150, although other shapes are envisioned.

In use, the first groove 310 formed in the bottom surface 304 may have a depth D1. The second groove 312 formed in the bottom surface 304 may have a depth D2. The depth D1 of the first groove 310 may be greater than the depth D2 of the second groove 312. As will be described in greater detail below, by forming the first and second grooves 310, 312 so that they are substantially transverse with respect to each other, in use the user may rotate the pucks 300 between first and second positions. In the first position (FIG. 11), the first or deeper groove 310 formed in the bottom surface 304 of the puck 300 may be in contact with the outer surface 192 of the longitudinal rod 190, while in the second position (FIG. 12), the second or shallower groove 312 formed in the bottom surface 304 of the puck 300 may be in contact with the outer surface 192 of the longitudinal rod 190. As will be appreciated, in use, due to the second or shallower grooves 312, in the second position, the effective thickness of the puck 300 is bigger than the effective thickness of the pucks 300 when in the first position. As such, with the rod 190 in contact with the second or shallower groove 312, the rod 190 will be sandwiched between the puck 300 and the bottom surface of the base member 168 formed in the bottom rail 150, thereby holding the rod 190 in a desired position relative to the bottom rail 150. That is, in the second position, the puck 300 exerts increased force as compared with the puck 300 when in the first position.

In one embodiment, when grooves 310, 312 are formed in both the top and bottom surfaces 302, 304, the first groove 310 formed in the top surface 302 may be longitudinally aligned with the second groove 312 formed in the bottom surface 304, similarly the second groove 312 formed in the top surface 302 may be longitudinally aligned with the first groove 310 formed in the bottom surface 304. As a result, the first groove 310 formed in the top surface 302 may be positioned transverse with respect to the first groove 310 formed in the bottom surface 304, and the second groove 312 formed in the top surface 302 may be positioned transverse to the second groove 304 formed in the bottom surface 304, although other angles are envisioned. In this manner, the pucks 300 can be positioned within the weight channel 182 along the outer surface 192 of the longitudinal rod 190 in any position. That is, by forming first and second grooves 310, 312 in the top and bottom surfaces 302, 304, the pucks 300 can function as desired regardless which of the top and bottom surfaces 302, 304 is placed into contact with the outer surface 192 of the longitudinal rod 190. Thus, for example, the system and method will operate with the top surface 302 of the pucks 300 contacting the outer surface 192 of the longitudinal rod 190, or with the bottom surface 304 of the pucks 300 contacting the outer surface 192 of the longitudinal rod 190.

In addition, as shown in FIGS. 7-9, each of the pucks 300 may include an opening 330 formed in the side surface 306 thereof. As will be described in greater detail below, the opening 330 may be sized and configured to receive a tool such as, for example, the tip of a screwdriver, to enable a user to manually rotate the pucks 300 between the first and second positions. As illustrated, the opening 330 may extend completely through the puck 300 from one end of the side surface 306 to the other. Alternatively, it is envisioned that the opening 330 may only extend partially therethrough. As shown, a first end 332 (FIGS. 7 and 9) of the opening 330 may have an enlarged opening as compared to a second end 334 (FIG. 8) of the opening 330. In this manner, the enlarged opening formed at the first end 332 of the opening 330 is better able to receive a tip of a tool such as, for example, a tip of a screwdriver.

Figure 13:
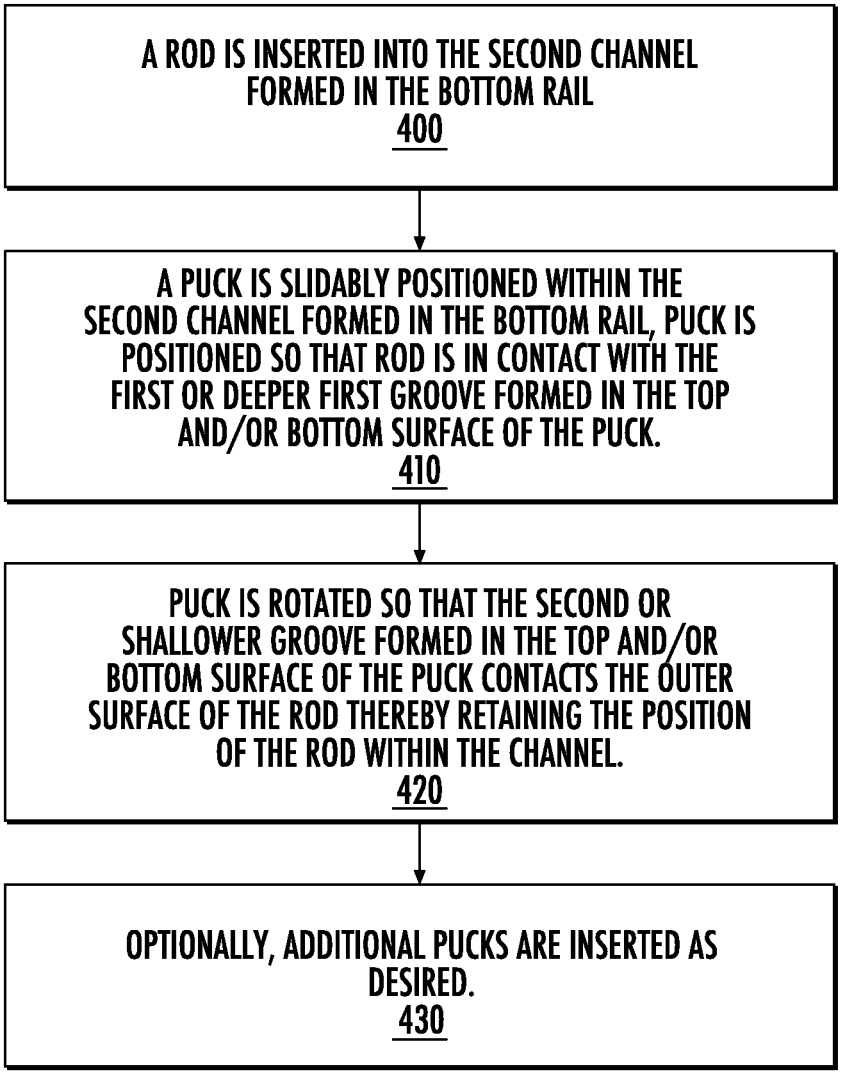
FIG. 13 is an illustrative example embodiment of a method of retaining a rod within a channel formed in the bottom rail.

Referring to FIG. 13, an illustrative example embodiment of a method of positioning the rod 190 within the weight channel 182 of the bottom rail 150 (e.g., within the weight channel 182 formed in the bottom portion 180 of the bottom rail 150) of the present disclosure will now be described. At 400, a rod 190 may be inserted into the weight channel 182 formed in the bottom rail 150. For example, the rod 190 may be slidably inserted into the weight channel 182 by slidably inserting the rod 190 from an end 150*a*, 150*b* of the bottom rail 150. At 410, one or more pucks 300 may be positioned within the weight channel 182 formed in the bottom rail 150. In use, the pucks 300 are positioned so that the first or deeper channel 310 formed in either the top or bottom surface 302, 304 is placed into contact with the outer surface 192 of the longitudinal rod 190. If so desired, the user may insert the tip of a tool such as, for example, a screwdriver into the enlarged opening 332 formed in the side surface 306 of the puck 300 to insert and position the puck 300 at a desired position within the weight channel 182. At 420, the user may rotate the puck 300 by, for example, ninety-degrees. As a result of rotating the puck 300, the puck 300 rotates so that the second or shallower depth channel 312 contacts the outer surface 192 of the rod 190, which causes the puck 300 to apply an outward force onto the rod 190 pressing the rod 190 into the weight channel 182 formed in the bottom rail 150 thereby sandwiching the rod 190 between the puck 300 and the bottom rail 150, and thus retaining the position of the rod 190 within the weight channel 182. That is, rotation of the puck 300 within the weight channel 182 of the bottom rail 150 causes the puck 300 to apply an increased force against the outer surface 192 of the rod 190 to hold or retain the position of the puck 300 with respect to the rod 190 and hence the position of the rod 190 with respect to the weight channel 182 of the bottom rail 150. At 430, additional pucks 300 may be inserted as desired.

In one configuration, a bottom rail for coupling to a covering of an architectural-structure covering includes a front wall, a rear wall, and a channel formed between the front and rear walls. The channel being sized and configured to receive a bottom edge of the covering. The front wall includes an inwardly extending front projection and the rear wall includes an inwardly extending rear projection, the front and rear projections being asymmetric.

An architectural-structure covering is also disclosed. In one configuration, the architectural-structural covering includes a covering moveable between an extended position and a retracted position; a strip coupled to a bottom edge of the covering, the bottom edge of the covering being wrapped about the strip; and a bottom rail for receiving the strip and the bottom edge of the covering wrapped about the strip. The bottom rail includes a front wall, a rear wall, and a channel formed between the front and rear walls, the channel includes a recess formed in the channel for receiving the strip and the bottom edge of the covering wrapped about the strip. The front wall includes an inwardly extending front projection and the rear wall includes an inwardly extending rear projection, the front and rear projections being asymmetric.

In one configuration, a bottom rail for coupling to a covering of an architectural-structure covering includes a channel (e.g., a weight channel) for receiving a longitudinal rod therein and at least one puck positioned within the weight channel. In a first position, the at least one puck is slidably positioned along an outer surface of said longitudinal rod and the longitudinal rod is slidably positioned within the weight channel. In a second position, the at least one puck contacts the longitudinal rod to retain a position of the longitudinal rod within the weight channel.

A method for positioning a longitudinal rod within a weight channel formed in a bottom rail is also disclosed. The method including inserting the longitudinal rod into the weight channel formed in the bottom rail, inserting one or more pucks into the weight channel formed in the bottom rail wherein the one or more pucks are in contact with the longitudinal rod, and rotating the one or more pucks from a first unlocked position where the one or more pucks are slidably positionable along the outer surface of the longitudinal rod, to a second locked position wherein the one or more pucks contact the longitudinal rod so that the longitudinal rod is retained within the weight channel.

A method for coupling a bottom rail to a covering of an architectural-structure covering. The method including providing a covering including a plurality of cells, each cell including a front sheet and a rear sheet, removing the front sheet of a lowermost cell of the covering thereby leaving only the rear sheet of the lowermost cell, coupling a strip to the rear sheet of the lowermost cell, and inserting said the strip and a portion of the rear sheet of the lowermost cell into a channel formed in a top portion of a bottom rail.

While the present disclosure makes reference to certain illustrated embodiments depicting one or more aspects of the present disclosure that may be used independently, or in combination with each other, numerous modifications, alterations, and changes to the described embodiments are possible without departing from the sphere and scope of the present disclosure, as defined in the appended claim(s). For example, it is envisioned that a bottom rail may include a channel for coupling to a covering without incorporating a channel for receiving a longitudinal rod. Alternatively, a bottom rail may include a channel for receiving a longitudinal rod without incorporating a channel for coupling to a covering. Alternatively, as illustrated, a bottom rail may incorporate both a channel for coupling to a covering and a channel for receiving a longitudinal rod. Accordingly, it is intended that the present disclosure not be limited to the described and illustrated embodiments, but that it has the full scope defined by the language of the following claims, and equivalents thereof.

The foregoing description has broad application. It should be appreciated that the concepts disclosed herein may apply to many types of coverings, in addition to the roller-type coverings described and depicted herein. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The phrases "at least one", "one or more", and "and/or", as used herein, are open-ended expressions that are both conjunctive and disjunctive in operation. The terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., engaged, attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative to sizes reflected in the drawings attached hereto may vary.

The invention claimed is:

1. A bottom rail for coupling to a covering of an architectural structure covering, the bottom rail comprising:

a longitudinal rod including an outer surface and a longitudinal length;

a weight channel for receiving said longitudinal rod therein; and at least one puck positioned within said weight channel;

wherein each of said at least one puck includes a top surface, a bottom surface, and a side surface, one of said top and bottom surfaces including a first groove and a second groove formed therein;

wherein, when in a first position, said at least one puck is slidably positioned along said outer surface of said longitudinal rod, said at least one puck is slidably positioned along said longitudinal length of said longitudinal rod, and said longitudinal rod is slidably positioned within said weight channel, and, when in a second position, said at least one puck contacts said longitudinal rod to retain a position of said longitudinal rod within said weight channel.

2. The bottom rail of claim 1, wherein said at least one puck includes a cylindrical shape.

3. The bottom raid of claim 1, wherein said first groove is transversely positioned with respect to said second groove.

4. The bottom rail of claim 1, wherein said first groove has a depth D1, and said second groove has a depth D2, said depth D1 of said first groove is different than said depth D2 of said second groove.

5. The bottom rail of claim 4, wherein, when in said first position, said first groove is in contact with said outer surface of said longitudinal rod, and, when in said second position, said second groove is in contact with said outer surface of said longitudinal rod.

6. The bottom rail of claim 1, wherein said top or bottom surface includes a plurality of peaks positioned between said first and second grooves.

7. The bottom rail of claim 1, wherein both of said top and bottom surfaces includes respective first and second grooves.

8. The bottom rail of claim 7, wherein said first groove formed in said top surface is longitudinally aligned with said second groove formed in said bottom surface, and said second groove formed in said top surface is longitudinally aligned with said first groove formed in said bottom surface.

9. The bottom rail of claim 7, wherein said first groove formed in said top surface is positioned transverse with respect to said first groove formed in said bottom surface, and said second groove formed in said top surface is positioned transverse to said second groove formed in said bottom surface.

10. The bottom rail of claim 1, further comprising an opening formed in said side surface of each of said at least one puck, said opening being sized and configured to receive a tool tip for facilitating rotation of said at least one puck from said first position to said second position.

* * * * *